US008348364B2

(12) United States Patent
Taga

(10) Patent No.: US 8,348,364 B2
(45) Date of Patent: Jan. 8, 2013

(54) FLUID SUPPLY DEVICE, PRINTING DEVICE, AND METHOD OF CLEANING A PRINTING DEVICE

(75) Inventor: Susumu Taga, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 492 days.

(21) Appl. No.: 12/611,404

(22) Filed: Nov. 3, 2009

(65) Prior Publication Data

US 2010/0110119 A1 May 6, 2010

(30) Foreign Application Priority Data

Nov. 4, 2008 (JP) ..... 2008-283147

(51) Int. Cl.
*B41J 2/195* (2006.01)

(52) U.S. Cl. ..... 347/7; 347/5; 347/6; 347/14; 347/19; 347/22; 347/23; 347/30; 347/31; 347/32; 347/33; 347/34; 347/35; 347/36; 347/84; 347/85; 347/86; 347/87

(58) Field of Classification Search ..... 347/5–7, 347/14, 19, 22–23, 30–36, 84–87
See application file for complete search history.

(56) References Cited

U.S. PATENT DOCUMENTS

| | | | | |
|---|---|---|---|---|
| 6,217,146 | B1 * | 4/2001 | Takahashi et al. | 347/33 |
| 6,378,971 | B1 | 4/2002 | Tamura et al. | |
| 6,582,068 | B2 | 6/2003 | Ishizawa et al. | |
| 6,758,556 | B2 | 7/2004 | Ishizawa et al. | |
| 6,786,566 | B2 | 9/2004 | Shindo | |
| 6,796,627 | B2 | 9/2004 | Kimura et al. | |
| 6,834,945 | B2 | 12/2004 | Ishizawa et al. | |
| 6,874,876 | B2 | 4/2005 | Ishizawa et al. | |
| 7,152,965 | B2 | 12/2006 | Ishizawa et al. | |
| 7,380,909 | B2 | 6/2008 | Ishizawa et al. | |
| 7,878,632 | B2 | 2/2011 | Kachi | |
| 2002/0130918 | A1 * | 9/2002 | Hayakawa et al. | 347/29 |
| 2004/0246294 | A1 * | 12/2004 | Mitsuzawa | 347/23 |
| 2007/0195140 | A1 | 8/2007 | Ishizawa et al. | |
| 2007/0279462 | A1 | 12/2007 | Ishizawa et al. | |

FOREIGN PATENT DOCUMENTS

| | | | |
|---|---|---|---|
| JP | 09-300645 | A | 11/1997 |
| JP | 11-138856 | A | 5/1999 |
| JP | 2001-270133 | A | 10/2001 |
| JP | 2003-246085 | A | 9/2003 |
| JP | 2005-059304 | A | 3/2005 |
| JP | 2007-160639 | A | 6/2007 |
| JP | 2008-087286 | A | 4/2008 |

* cited by examiner

*Primary Examiner* — Ryan Lepisto
*Assistant Examiner* — Guy Anderson
(74) *Attorney, Agent, or Firm* — Kilpatrick Townsend & Stockton LLP

(57) ABSTRACT

A fluid supply device, a printing device, and a method of cleaning a printing device are disclosed. A fluid supply device includes a main tank, a fluid chamber, a fluid-discharging head, a movable carriage, an expansion mechanism that expands the fluid chamber to draw fluid from the main tank, a suction mechanism, a remaining fluid detection unit, a comparison unit that compares the remaining fluid volume in the main tank with a specified value, and a setting unit that sets a cleaning mode. The expansion mechanism is actuated via a movement of the movable carriage. The setting unit sets a first cleaning mode in which a first amount of fluid is vacuumed from the nozzle or a second cleaning mode in which a second amount of fluid is vacuumed from the nozzle that is less than the first amount. The cleaning mode is selected in response to the amount of fluid remaining in the main tank.

15 Claims, 10 Drawing Sheets

FLUID SUPPLY DEVICE, PRINTING DEVICE, AND METHOD OF CLEANING A PRINTING DEVICE

This application claims priority to Japanese Application No. 2008-283147, filed Nov. 4, 2008, the entirety of which is incorporated by reference herein.

BACKGROUND

1. Technical Field

The present invention relates to a fluid supply device that supplies fluid from a main tank through a subtank to a fluid-discharging head, to a printing device, and to a method of cleaning a printing device.

2. Description of Related Art

One example of a fluid supply device is a device that is incorporated in a printer connected to a personal computer, for example, and supplies ink as the fluid to an inkjet recording head. Japanese Unexamined Patent Appl. Pub. JP-A-2001-270133, for example, teaches a fluid supply device that has a subtank unit, a pump, and a pump control means. The subtank unit is mounted on a carriage, receives ink that is supplied through an ink supply tube from an ink cartridge into a storage chamber, and supplies ink from the ink storage chamber to an inkjet recording head when printing. The pump supplies ink from the ink cartridge to the subtank unit. The pump control means controls the ink flow according to a drive signal applied to the inkjet recording head. However, the pump has a relatively complex configuration and requires a large installation space.

Devices that use the drive power of the bidirectional movement of the carriage to supply ink in order to simplify and reduce the size of the pump are also known from the literature. See, for example, Japanese Unexamined Patent Appl. Pub. JP-A-2007-160639. The ink supply device taught in JP-A-2007-160639 has a carriage that moves bidirectionally, an ink cartridge that stores ink to be supplied to an inkjet recording head disposed on the carriage, an ink holding unit that holds the ink consumed during printing by the inkjet recording head, and an ink pump unit. The ink pump unit is compressed and supplies ink to the ink holding unit as a result of the carriage moving to a specified position, and expands and draws ink from the ink cartridge as a result of the carriage moving to a position separated from the specified position. The ink holding unit is used as a buffer for storing the ink delivered from the ink pump unit, and thus tends to increase device size and cost.

In light of the above, it would be desirable to have improved fluid supply devices and printing devices with reduced cost and/or complexity. It would also be desirable to have methods for cleaning such fluid supply devices and printing devices in an economical manner.

SUMMARY

A fluid supply device, a printing device, and a method for cleaning a printing device are provided. In many embodiments, a fluid supply device includes a main fluid tank; a variable-volume fluid chamber in fluid communication with the main fluid tank; an expansion mechanism for varying the size of the fluid chamber so as to draw fluid from the main tank; a fluid-discharging head that draws fluid from the fluid chamber; and a bi-directional movement carriage to which the fluid-discharging head, the fluid chamber, and the expansion mechanism are mounted. The expansion mechanism can be actuated by a movement of the carriage. Such a fluid supply device has a simple configuration, which may result in reduced device size and cost. A vacuum cleaning process can be used in an economical manner to remove air bubbles in the fluid chamber while greatly suppressing the amount of fluid wasted during the vacuum cleaning process. The vacuum cleaning may help to maintain good fluid discharge operation.

In a first aspect, a fluid supply device is provided. The fluid supply device includes a main tank in which fluid is stored, a fluid chamber to which fluid is supplied from the main tank, a head that discharges fluid supplied from the fluid chamber, a movable carriage on which the head and the fluid chamber are mounted, an expansion mechanism that causes the fluid chamber to expand so as to draw fluid from the main tank, a suction mechanism, a remaining fluid detection unit that determines a remaining fluid volume in the main tank, a comparison unit that compares the remaining fluid volume in the main tank with a specified value, and a setting unit that sets a cleaning mode. The head includes a fluid discharge nozzle. The expansion mechanism is actuated via a movement of the movable carriage. The suction mechanism vacuums fluid from the fluid discharge nozzle and cleans the nozzle. The setting unit sets a cleaning mode selected from a group consisting of a first cleaning mode in which a first amount of fluid is vacuumed from the nozzle and a second cleaning mode in which a second amount of fluid is vacuumed from the nozzle that is less than the first amount. The fluid supply device cleans the nozzles in the first cleaning mode when the remaining fluid volume in the main tank is determined to be greater than or equal to the specified value as a result of the comparison unit comparing the remaining fluid volume in the main tank with the specified value, and cleans the nozzles in the second cleaning mode when the remaining fluid volume is less than the specified value.

In many embodiments, the expansion mechanism is configured to allow the fluid chamber to compress in response to fluid being drawn from the fluid chamber during the vacuum cleaning process. Compression of the fluid chamber can be used to clear air bubbles from the fluid chamber by forcing air bubbles out of the fluid chamber. In many embodiments, fluid is stored in the main tank in sealed storage units of variable capacity and increasing levels of vacuum pressure are required to draw the fluid from the main tank as the remaining fluid volume in the main tank decreases. The fluid chamber can be partially compressed at the start of the cleaning process due to the vacuum pressure required to draw fluid from the main tank. Such partial compression of the fluid chamber can increase as the remaining fluid volume in the main tank decreases. As a result, the amount of fluid in the fluid chamber at the start of the cleaning process is reduced as a result of the remaining fluid volume in the main tank decreasing. Furthermore, because a first cleaning mode is selected when the remaining fluid volume in the main tank is greater than or equal to a specified value, and a second cleaning mode is selected for vacuum cleaning when the remaining fluid volume in the main tank is less than the specified value, vacuum cleaning can be accomplished in a manner in which fluid wasted during the vacuum cleaning is significantly reduced. In other words, vacuum cleaning can be desirably applied to remove bubbles from inside the fluid chamber while minimizing fluid waste in conjunction with vacuum cleaning, a desirable fluid discharge operation can be maintained, and device size and cost can be reduced with a simple configuration.

In many embodiments, a recess that communicates with a fluid path to the head is formed in the fluid chamber. When the fluid chamber is compressed during vacuum cleaning, air bubbles in the fluid chamber are guided into the recess and are drawn from the recess into the fluid path and purged.

In many embodiments, the amount of fluid vacuumed from the discharge nozzle when vacuum cleaning in the first cleaning mode changes according to the remaining fluid volume in the main tank. By varying the amount of fluid vacuumed from the discharge nozzle when cleaning in the first cleaning mode in response to the remaining fluid volume in the main tank, the amount of fluid wasted during the cleaning process can be further reduced.

In many embodiments, the remaining fluid detection unit measures the remaining fluid volume in the main tank from an electrical current required to move the carriage. In such embodiments, the electrical current required to move the carriage changes according to the remaining fluid volume in the main tank, and can thus can be used to smoothly change the vacuum cleaning mode.

In many embodiments, the remaining fluid detection unit determines the remaining fluid volume in the main tank from a volume of fluid discharged from the head. In such embodiments, the remaining fluid volume in the main tank can be determined from a cumulative amount of fluid discharged from the head, and can thus can be used to smoothly change the vacuum cleaning mode.

In many embodiments, a printing device executes a printing process by discharging ink from a head onto a conveyed medium, and includes an above described fluid supply device. In such embodiments, the printing device can desirably apply vacuum cleaning to remove bubbles from inside the fluid chamber while minimizing ink waste in conjunction with vacuum cleaning, can maintain desirable ink discharge, and can print efficiently with high quality.

In another aspect, a method for cleaning a printing device is provided. The method includes measuring a remaining ink volume in a main tank of the printing device, comparing the remaining ink volume with a predetermined volume of ink, selecting a first cleaning mode when the remaining ink volume is greater than or equal to the predetermined volume, selecting a second cleaning mode when the remaining ink volume is less than the predetermined value, and suctioning an amount of ink from an ink-discharging head of the printing device. The amount of ink suctioned is determined in response to the selected cleaning mode. The amount of ink suctioned for the first cleaning mode exceeds the amount of ink suctioned for the second cleaning mode.

In many embodiments, a method for cleaning a printing device can be employed to clean a printing device having the above described fluid supply device. For example, the amount of ink suctioned can include ink drawn from a chamber, which is in fluid communication with the main tank. The volume of the chamber can be reduced in response to the ink being drawn from the chamber. The amount of ink suctioned when cleaning in the first mode can be changed in response to the remaining ink volume in the main tank. The remaining ink volume in the main tank can be determined from an electrical current required to move a carriage on which the ink-discharging head and the chamber are mounted. Such embodiments can provide the benefits discussed above with regard to the above discussed fluid supply devices.

Other objects and attainments together with a fuller understanding of the invention will become apparent and appreciated by referring to the following description and claims taken in conjunction with the accompanying drawings.

DETAILED DESCRIPTION

Embodiments of a fluid supply device, a printing device, and a method for cleaning a printing device are described below with reference to the accompanying figures. The construction of an inkjet printer in accordance with an embodiment is described first.

Figure 1:
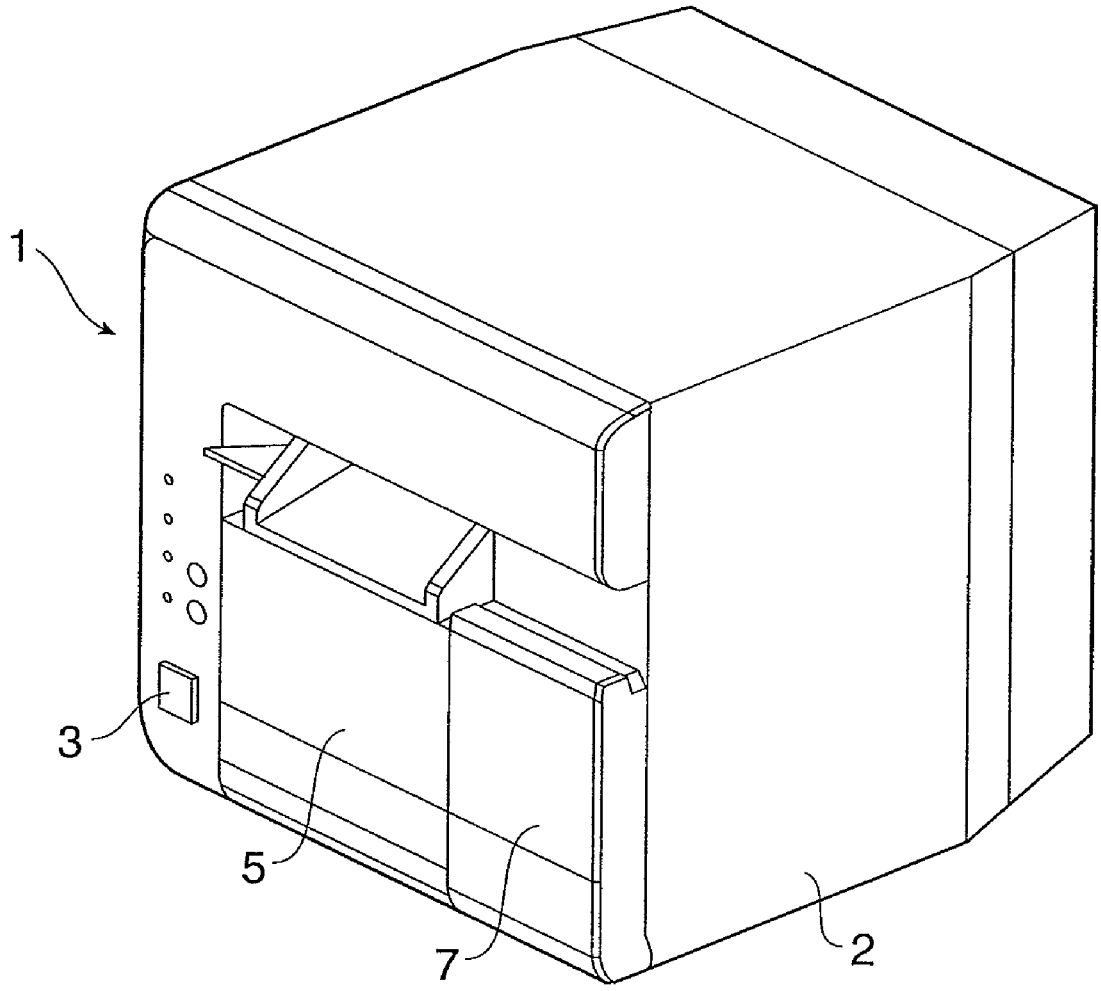
FIG. 1 is a perspective view of an inkjet printer, in accordance an embodiment of the present invention.

FIG. 1 illustrates an inkjet printer 1, in accordance with an embodiment. The inkjet printer 1 can use a plurality of different colors of ink to print in color on paper delivered from a roll of paper. The inkjet printer 1 includes a printer case 2. A power switch 3, a paper feed switch, and indicators disposed on the front of the printer case 2. A roll paper cover 5 and an ink cartridge cover 7 disposed to open and close freely at the front of the printer case 2.

Figure 2:
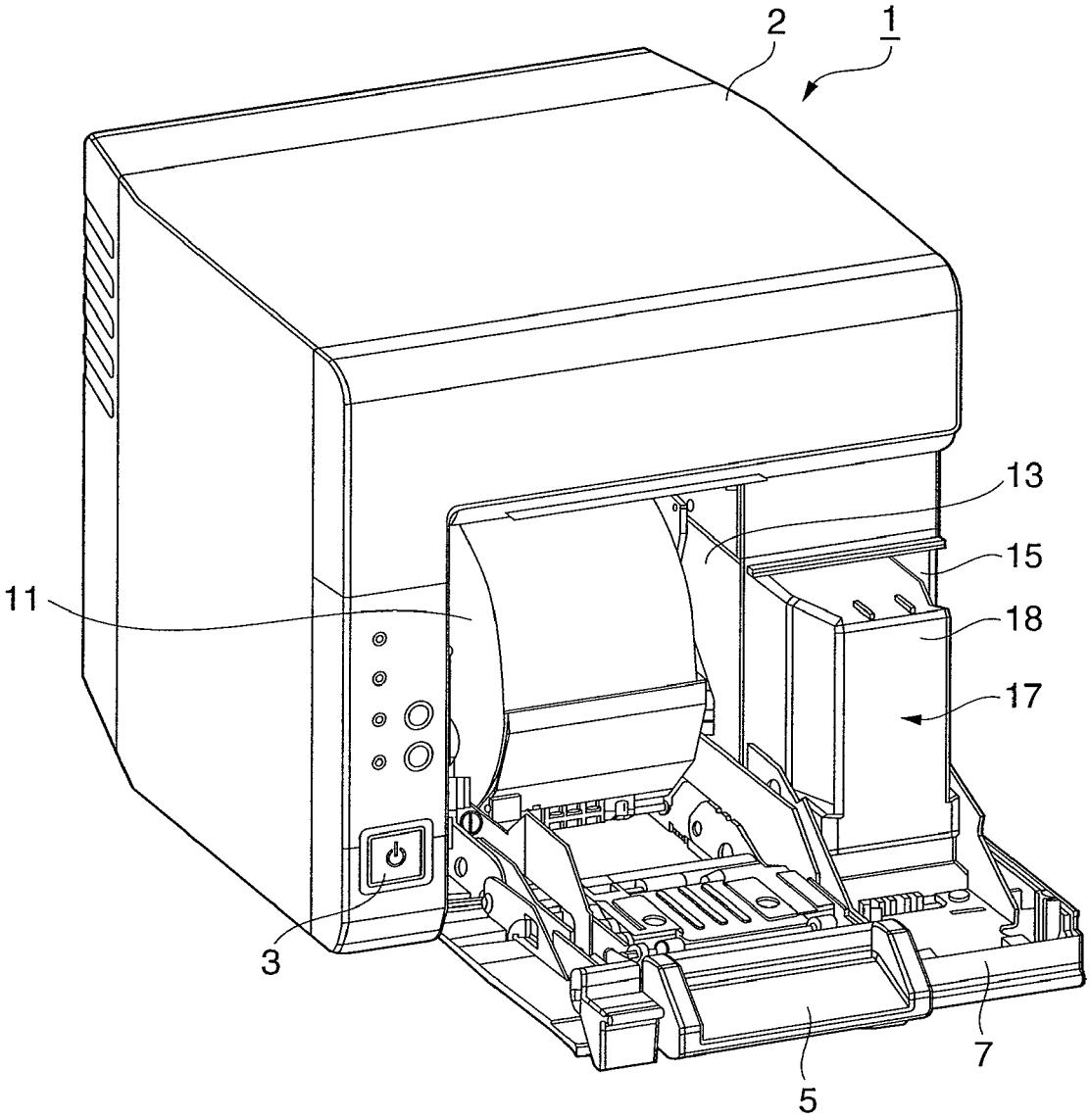
FIG. 2 is a perspective view of the inkjet printer shown in FIG. 1 with the printer covers open.

FIG. 2 illustrates the inkjet printer 1 with printer covers open. Opening the roll paper cover 5 opens a paper compartment 13, thereby providing access to a roll paper 11 used as the print medium so that the roll paper 11 can be replaced. Opening the ink cartridge cover 7 opens a cartridge loading unit 15, enabling installation and removal of an ink cartridge 17 (main tank) in the cartridge loading unit 15. Opening of the ink cartridge cover 7 also causes the ink cartridge 17 to be pulled a specific distance forward in front of the cartridge loading unit 15.

Figure 3:
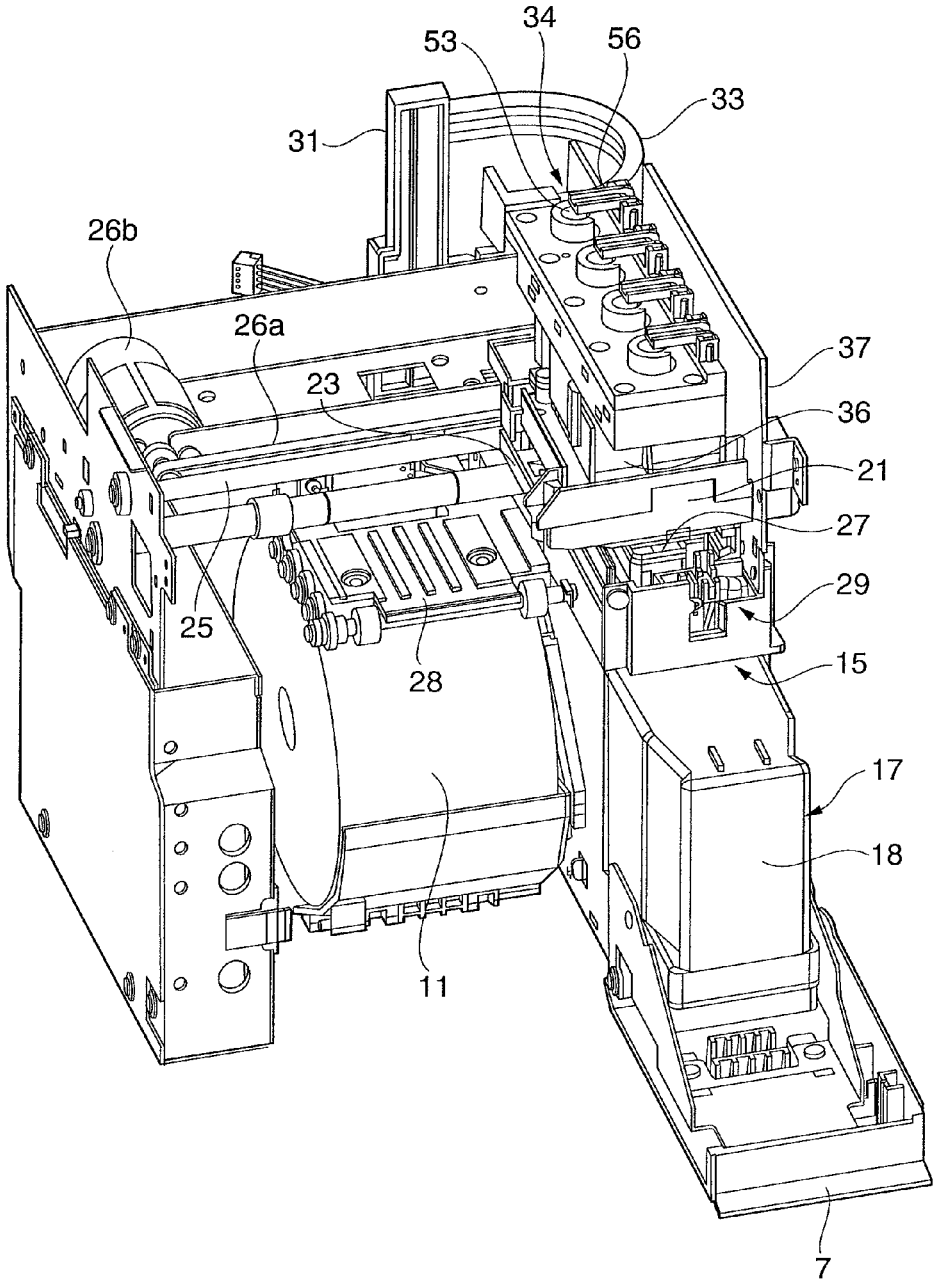
FIG. 3 is a perspective view of the inkjet printer shown in FIG. 1 with the printer case removed.

FIG. 3 illustrates the inkjet printer 1 with the printer cover 2 removed. A moving carriage 23 is disposed above the paper compartment 13 inside the printer case 2. The carriage 23 is supported to move freely widthwise relative to the paper by means of a guide member 25 that extends widthwise relative to the roll paper 11, and can be moved bidirectionally widthwise relative to the roll paper 11 above a platen 28 by means of an endless belt 26*a* oriented widthwise relative to the roll paper 11 and a carriage motor 26*b* that drives the endless belt 26*a*. An inkjet head 21 (head) is mounted on the carriage 23. The inkjet head 21 prints by discharging ink to a part of the roll paper 11 delivered thereto.

The bidirectionally moving carriage 23 is illustrated in a standby position (home position) above the cartridge loading unit 15. In the standby position, a cap 27 covers ink-discharging nozzles of the inkjet head 21 exposed below the carriage 23. An ink vacuum mechanism 29 (vacuum mechanism) is disposed below the standby position of the carriage 23.

At a specific timing or when initiated by user operation, the inkjet printer 1 executes a cleaning process in which the vacuum mechanism 29 vacuums ink from inside the ink-discharging nozzles of the inkjet head 21 to draw any air bubbles or high viscosity ink out from the ink nozzles. During the cleaning process, the cap 27 is set tight to the ink nozzle surface of the inkjet head 21.

The inkjet printer 1 also executes a flushing process regularly or before or after a printing process. During the flushing process, a specific volume of ink droplets is discharged from the ink nozzles of the inkjet head 21 into the cap 27 in order to form an ink meniscus in the ink nozzles of the inkjet head 21.

The inkjet printer 1 also executes a capping operation to protect and prevent clogging of the ink nozzles. During the capping operation, the cap 27 is set tight to the ink nozzle surface of the inkjet head 21 when the carriage 23 is positioned at the home position after printing stops.

In many embodiments, the ink cartridge 17 stores a plurality of color ink packs (not shown) inside a cartridge case 18. Each of the ink packs (storage units) inside the ink cartridge 17 can be made of a flexible material and sealed with ink stored inside. When the ink cartridge 17 is loaded into the cartridge loading unit 15, an ink supply needle (not shown) disposed on the cartridge loading unit 15 side is inserted to and connects with the ink supply opening of the ink pack. An ink path 31 fixed inside the printer case 2 is connected to the ink supply needle of the cartridge loading unit 15. A flexible ink supply tube 33 having a channel for each color is connected to the ink path 31.

The other end of the ink supply tube 33 is connected to an ink pump unit 34 disposed on the carriage 23 for each color. Each ink pump unit 34 is disposed above the inkjet head 21, and is connected to a self-sealing unit 36, which is connected to the inkjet head 21. In addition to the inkjet head 21, the ink pump units 34 and the self-sealing units 36 are mounted to the carriage 23. As a result, ink from each ink pack inside the ink cartridge 17 is supplied to the ink nozzles of the inkjet head 21 from the ink supply needle of the cartridge loading unit 15 through the ink path 31, the ink supply tube 33, an ink pump unit 34 for each color, and a self-sealing unit 36 for each color.

Figure 4:
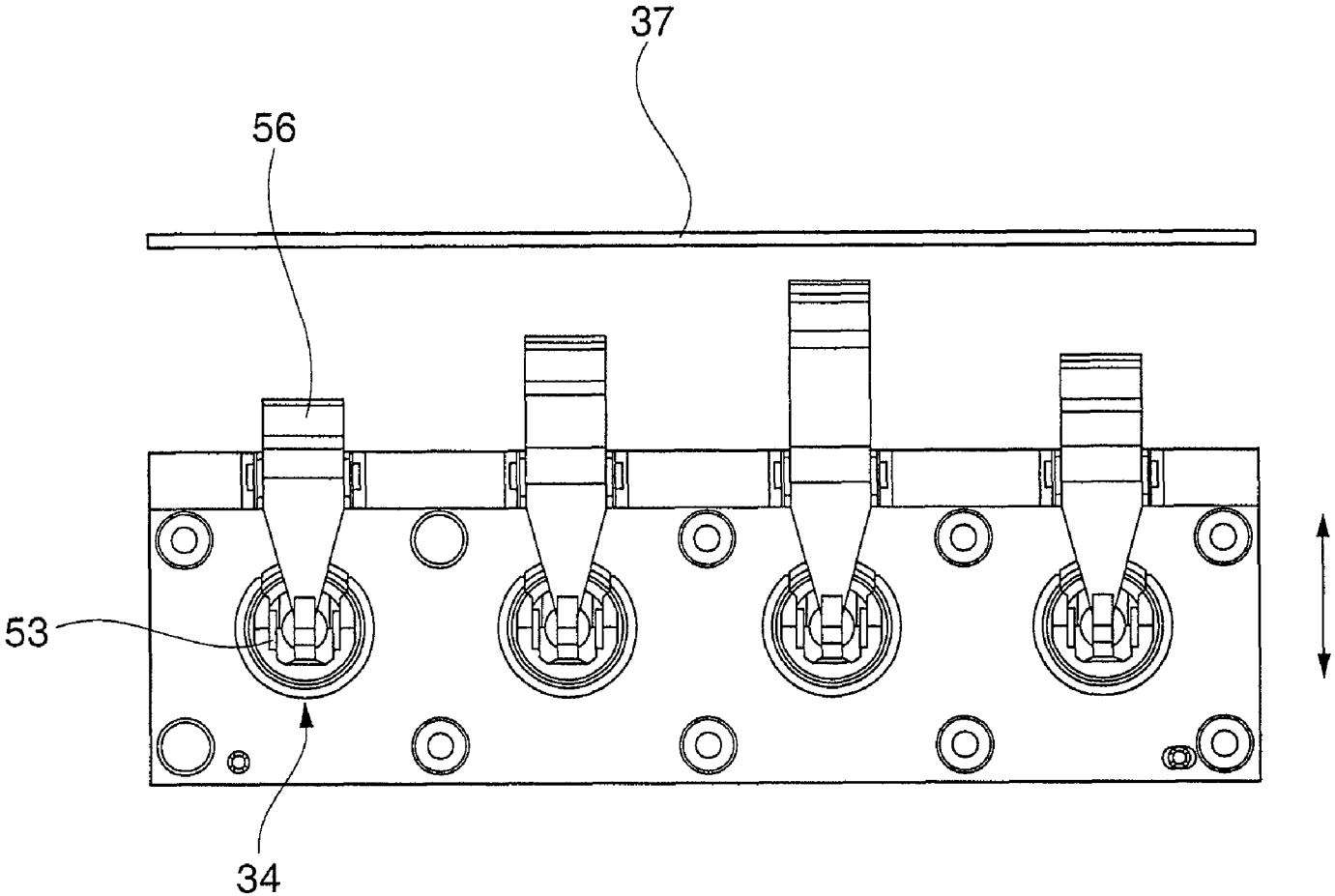
FIG. 4 is a plan view showing an ink pump unit and a regulator plate of the inkjet printer shown in FIG. 1.

FIG. 4 is a plan view illustrating four ink pump units 34 and a regulator plate 37. The regulator plate 37 is mounted to a frame of the inkjet printer. Each ink pump unit 34 draws ink from the ink cartridge 17 during a relative movement between the carriage 23 and the regulator plate 37. As the carriage moves into the standby position (i.e., towards the regulator plate 37), a rocker arm 56 for each ink pump unit 34 can come into contact with the regulator plate so as to actuate the ink pump unit by movement of the rocker arm 56.

Figure 5:
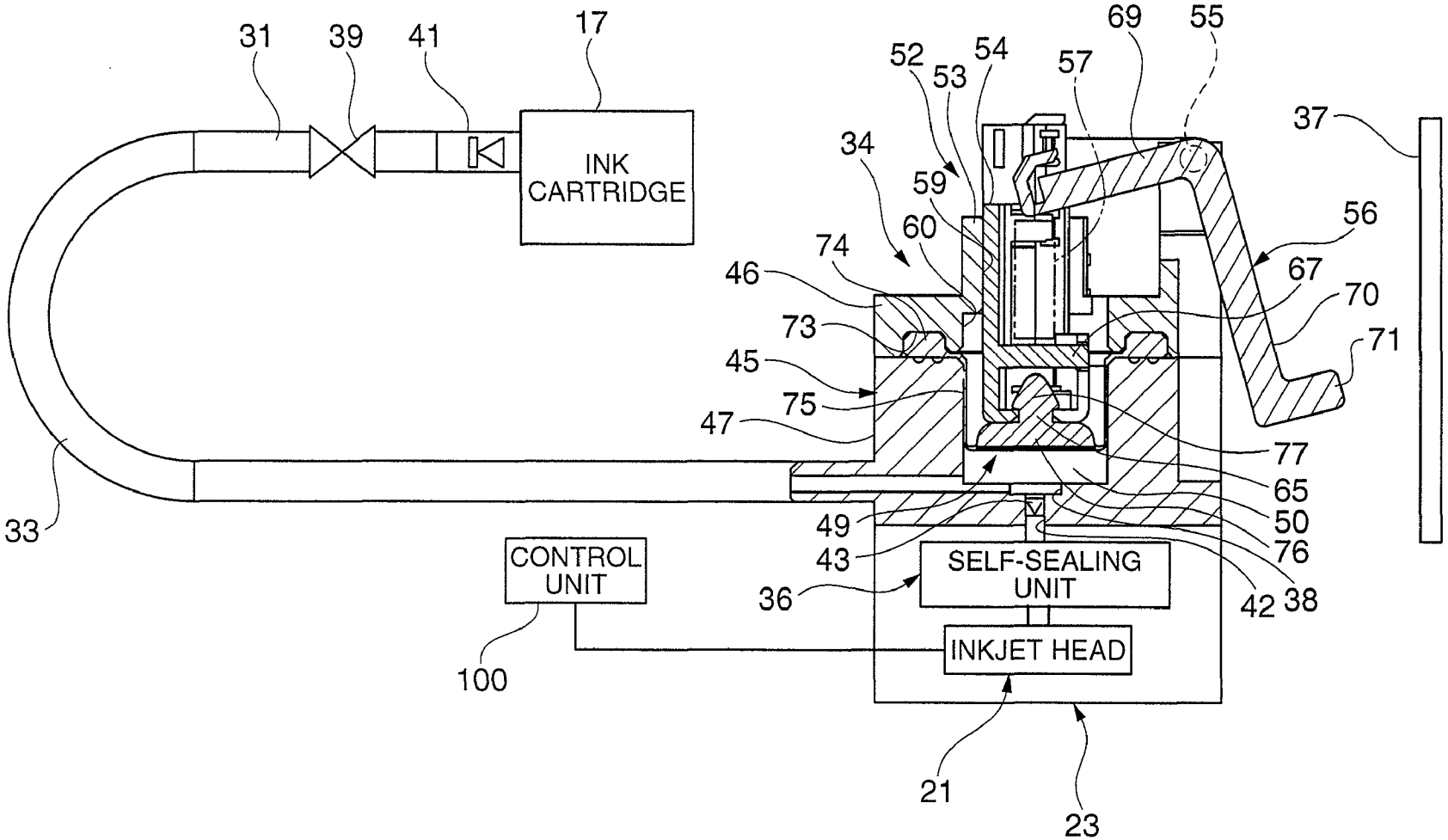
FIG. 5 shows a section view illustrating parts of an ink supply mechanism of the inkjet printer shown in FIG. 1, and diagrammatically illustrates FIG. 1 printer components that interact with the ink supply mechanism.

FIG. 5 illustrates parts of an ink supply mechanism of the inkjet printer 1, and diagrammatically illustrates printer components that interact with the ink supply mechanism. The ink supply mechanism (fluid supply mechanism) of the inkjet printer 1 includes the ink cartridge 17, a subtank 45, the inkjet head 21, the carriage 23, and the ink pump unit 34. The ink pump unit 34 of the ink supply mechanism is described below using by way of example the structure related to one color. A backflow prevention valve 41 is disposed at one end of the ink path 31 (on the ink cartridge 17 side). The backflow prevention valve 41 prevents ink from flowing between the ink cartridge 17 and the ink pump unit 34 from the ink pump unit 34 to the ink cartridge 17.

The ink pump unit 34 includes the subtank 45, which has atop part 46 and a bottom part 47, and an ink chamber 50 (fluid chamber). The ink chamber 50 is formed between the top part 46 and bottom part 47 with the top of the ink chamber 50 covered by a flexible membrane 49 forming a flexible diaphragm. The flexible membrane 49 can be made of butyl rubber, for example, with low moisture permeability and gas permeability.

The ink chamber 50 communicates with the ink supply tube 33 and with a path 42 to the self-sealing unit 36 side so that ink can be supplied from the ink cartridge 17 to the self-sealing unit 36. A backflow prevention valve 43 is positioned between the ink chamber 50 and the path 42 to the self-sealing unit 36. The backflow prevention valve 43 prevents ink from flowing between the ink chamber 50 and self-sealing unit 36 from the self-sealing unit 36 to the ink chamber 50.

The ink chamber 50 is a variable volume chamber that can be expanded to draw fluid from the ink cartridge 17. The flexible membrane 49 can be made from an easily deformable flexible material. The volume of the ink chamber 50 changes, expanding and contracting, as the flexible membrane 49 deforms.

The ink pump unit 34 includes an expansion mechanism 52 that can be actuated to cause the flexible membrane 49 to displace to expand the ink chamber 50 so as to draw ink from the ink cartridge 17 into the ink chamber 50. The expansion mechanism 52 includes a vertically-oriented cylinder 53, a piston 54 (moving member) that is inserted so that it can slide vertically inside the cylinder 53, a rocker arm 56 (engaging member) that is supported to rock on a rocker pin 55 above the cylinder 53 in the top part 46, and a coil tension spring 57 (elastic unit) that is interposed between the rocker arm 56 and piston 54. The cylinder 53 can be made from a plastic material such as polypropylene with low moisture permeability and gas permeability. The cylinder 53 has a necked configuration with a small diameter inside surface 59 formed at the top with an inside diameter that is slightly greater than the outside diameter of the piston 54 to slidably guide the outside surface of the piston 54, and a large diameter inside surface 60 formed at the bottom with a space between it and the outside surface of the piston 54. The piston 54 can be made from a plastic material such as polypropylene with low moisture permeability and gas permeability. The piston 54 is substantially cylindrical with a bottom, and has a slot from the top end to the middle on the rocker arm 56 side for positioning the rocker arm 56. A catch 67 that holds the bottom end of the coil tension spring 57 is formed at a position above the bottom of the piston 54. The rocker arm 56 has an arm part 69 that extends inside the cylinder 53 from the rocker pin 55, a vertical leg 70 that extends down from the rocker pin 55, and an input part 71 that extends in the opposite direction as the arm part 69 from the opposite end of the vertical leg 70 as the arm part 69. The distal end of the arm part 69 is hook shaped, and holds the top end of the coil tension spring 57.

The expansion mechanism 52 is operatively coupled with the flexible membrane 49. The flexible membrane 49 can be an integral molding. The flexible membrane 49 includes an annular thick-wall base part 74, a thin-wall membrane part 75, and a substantially disk shaped thick-wall part 76. The annular thick-wall base part 74 is disposed between the top part 46 and bottom part 47. The annular thick-wall base part 74 fits into an annular groove 73 in the top part 46. The thin-wall membrane part 75 extends with a cylindrical shape from the inside diameter part of the base part 74 to the outside diameter of the thick-wall part 76. The thick-wall part 76 is disposed in the central region of the membrane part 75. The thick-wall part 76 includes a nipple 77 that tapers substantially to a point at the distal end. The nipple 77 is press-fit into and held by a slit 65 formed in the piston 54. When thus disposed, the thick-wall part 76 is held in unison with the bottom of the piston 54, and the thick-wall part 76 and membrane part 75 of the flexible membrane 49 are displaced as the piston 54 moves.

In many embodiments, the ink chamber 50 is configured to guide air bubbles towards the inkjet head during a cleaning process. For example, a recess 38 that communicates with the flow path 42 can be formed in the bottom of the cylinder 53 part of the ink chamber 50. During a cleaning process, the recess 38 provides a collection area for air bubbles during compression of the ink chamber 50.

During a cleaning process, the ink path 31 can be opened or closed to control the flow of fluid between the ink cartridge 17 and the ink chamber 50. For example, a choke valve 39 can be closed during vacuum cleaning can be disposed in the ink path 31, and the ink path 31 can be opened and closed by the choke valve 39.

Figure 6:
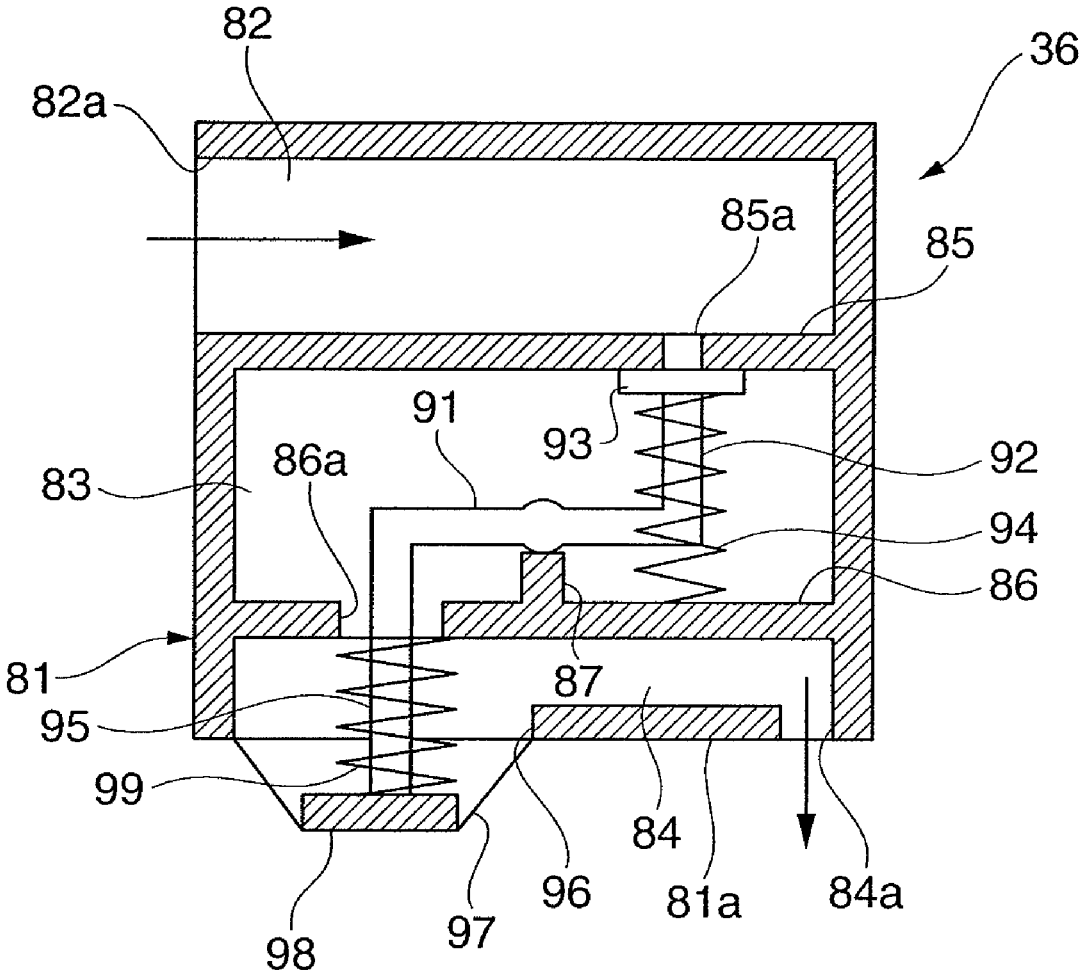
FIG. 6 is a section view showing the structure of a self-sealing unit of the inkjet printer shown in FIG. 1.

FIG. 6 is a section view illustrating a self-sealing unit 36. The self-sealing unit 36 has a supply path 82, a middle path 83, and a discharge path 84 formed in a unit housing 81. The upstream end part of the supply path 42 is in fluid communication with a supply opening 82*a*. The inkjet head 21 is connected to a discharge opening 84*a*, which is in fluid communication with the discharge path 84. A flow opening 85*a* is formed in a divider wall 85 separating the supply path 82 and the middle path 83. Ink in the supply path 82 flows through the flow opening 85*a* into the middle path 83. A communication hole 86*a* is formed in a divider wall 86 separating the middle path 83 and discharge path 84. Ink in the middle path 83 flows through the communication hole 86*a* into the discharge path 84.

The self-sealing unit 36 includes a mechanism for controlling the flow of fluid between the supply path 82 and the middle path 83. A support member 87 is formed on the divider wall 86 inside the middle path 83. A rocker arm 91 is pivotably supported on the support member 87. An operating rod 92 is fixedly coupled with a first end of the rocker arm 91. The operating rod 92 is oriented towards the divider wall 85. The operating rod is fixedly coupled with an occlusion plate 93 that is positionable so as to contact the divider wall 85 and close the flow opening 85*a*. A compression spring 94 is disposed between the occlusion plate 93 and divider wall 86. The occlusion plate 93 is urged toward the divider wall 85 side by the urging force of the compression spring 94. A pusher rod 95 is fixedly coupled with a second end of the rocker arm 91. The pusher rod 95 passes through the communication hole 86*a* in the divider wall 86. The pusher rod 95 is oriented traverse to the divider wall 86. An opening 96 is formed in a side wall 81*a* of the unit housing 81 on the discharge path 84 side. A film 97 that is liquid-tight and flexible is attached with a liquid-tight connection to the lip part of the opening 96. A pressure plate 98 is fixed to the middle part of the film 97 on the discharge path 84 side. The distal end of the pusher rod 95 part of the rocker arm 91 contacts this pressure plate 98. A compression spring 99 is attached between the pressure plate 98 and the divider wall 86. The pressure plate 98 is pushed to the outside by the urging force of the compression spring 99. The occlusion plate 93 in the self-sealing unit 36 is thus pressed to the divider wall 85 by the compression spring 94 and the pressure working on the occlusion plate 93, and thus closes the flow opening 85*a*.

In operation, when the pressure within the discharge path 84 decreases by a sufficient amount, the pusher rod 95 is pushed by the pressure plate 98, which causes the rocker arm 91 to rock at the point where it is supported on the support member 87. The rocking of the rocker arm 91 pulls down on the operating rod 92, which causes the occlusion plate 93 to separate from the divider wall 85. Ink thus flows from the supply path 82 through the flow opening 85*a* into the middle path 83 and discharge path 84, and is supplied to the inkjet head 21.

The self-sealing unit 36 can be used to isolate the inkjet head from variations in supply side ink pressure. For example, the self-sealing unit 36 can isolate the inkjet head from variation in the ink pressure on the supply side caused by acceleration or deceleration of the carriage 23. As a result, problems caused by transmission of such pressure variation, including unintended discharge of ink from the inkjet head 21, ink smears, and missing dots caused by defective discharge, for example, may be prevented.

The operation of the ink pump unit 34 will now be further discussed with reference to FIG. 5. When the carriage 23 is in the standby position in the inkjet printer 1 configured as described above, the input part 71 of the rocker arm 56 contacts the regulator panel 37 of the carriage 23, the vertical leg 70 is vertical, and the arm part 69 and input part 71 are horizontal. The piston 54 is pulled up by the urging force of the coil tension spring 57 at this time. As a result, the pressure within the ink chamber 50 is reduced, which draws ink into the ink chamber 50 from the ink cartridge 17. When the carriage 23 leaves the standby position and is moved to the printing area of the inkjet head 21, the input part 71 of the rocker arm 56 separates from the regulatory panel 37, thereby removing the urging force from the coil tension spring 57. When ink is then discharged from the inkjet head 21 in the printing area to print, ink is supplied from the self-sealing unit 36 to the inkjet head 21, the inside of the self-sealing unit 36 goes to negative pressure, and ink is supplied from the ink chamber 50 through the path 42 to the self-sealing unit 36. When the amount of ink in the ink chamber 50 drops, the decrease in ink produces negative pressure, and the piston 54 and the thick-wall part 76 descend in unison while deforming the membrane part 75 of the flexible membrane 49. As a result, the rocker arm 56 connected through the coil tension spring 57 to the piston 54 rocks and causes the distal end of the arm part 69 to descend, thus causing the amount that the rocker arm 56 protrudes to the input part 71 side to increase.

When the carriage 23 returns to the standby position, the input part 71 of the rocker arm 56 once again contacts the regulator panel 37 of the carriage 23. The contact causes the rocker arm 56 to rock as a result of carriage 23 movement, and the input part 71 returns to vertical and the arm part 69 and input part 71 return to horizontal. As a result, the distal end part of the arm part 69 rises, and the piston 54 connected thereto through the coil tension spring 57 slides inside the cylinder 53 and is pulled up.

Movement of the piston 54 through the coil tension spring 57 causes the thick-wall part 76 of the flexible membrane 49 of the ink pump unit 34 to rise in unison with the piston 54, expanding the ink chamber 50 of the subtank 45 and increasing its volume. When the volume of the ink chamber 50 increases, ink is drawn into the ink chamber 50 through the ink path 31 and ink supply tube 33 from the ink cartridge 17 while the backflow prevention valve 41 opens and the backflow prevention valve 43 closes.

A control unit 100 of the inkjet printer 1 configured as described above executes the above ink supply operation at a specific timing during the printing operation. Note that this ink supply operation is executed as long as there is at least enough ink left in the ink chamber 50 to enable supplying ink to the inkjet head 21 even if printing consumes the maximum amount of ink.

Figure 7:
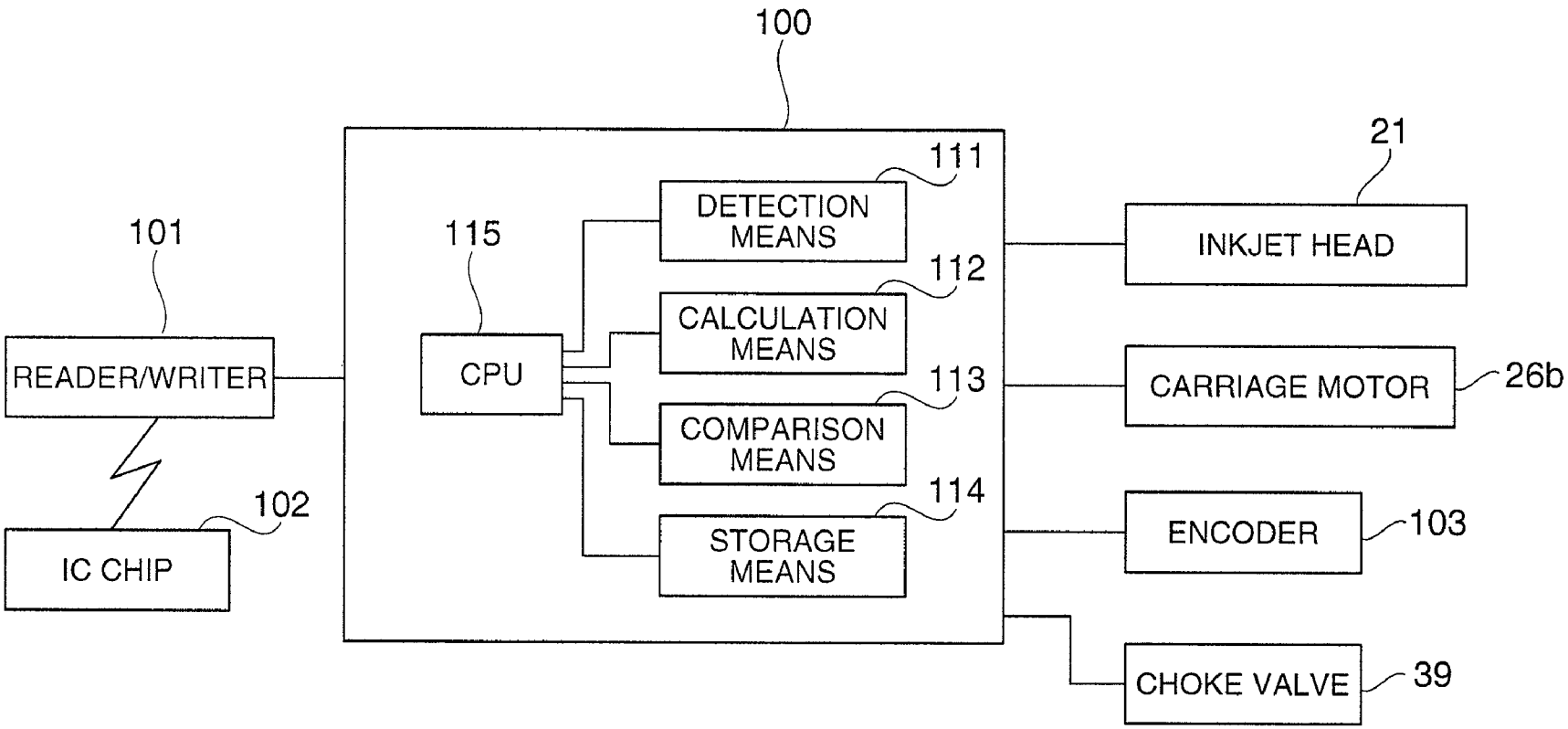
FIG. 7 is a block diagram describing a control system of the inkjet printer shown in FIG. 1.

FIG. 7 diagrammatically illustrates the control unit 100. The control unit 100 controls the operation of the inkjet head 21 and the carriage motor 26*b* by sending control signals to the inkjet head 21 and carriage motor 26*b*, for example, to execute a roll paper 11 printing process. An encoder 103 that sends carriage 23 position information is connected to the control unit 100, and the control unit 100 detects the position of the carriage 23 based on a signal from the encoder 103. The choke valve 39 that opens and closes the ink path 31 is connected to the control unit 100, and opening and closing the choke valve 39 is controlled by the control unit 100. The control unit 100 includes a detection means 111, a calculation means (remaining fluid detection unit) 112, a comparison means (comparison unit) 113, a storage means 114 and a CPU (settings unit) 115. The detection means 111, the calculation means 112, and the comparison means 113 are controlled by means of the CPU 115.

A reader/writer 101 is also connected to the control unit 100. The reader/writer 101 reads and writes ink information to an integrated circuit (IC) chip 102 disposed in the ink cartridge 17. The ink information written to the IC chip 102 includes, for example, ink consumption, the remaining ink level, the waste ink amount, the date of first use, and device information denoting the device using the ink cartridge 17, for example. The control unit 100 reads the ink information stored in the IC chip 102 of the ink cartridge 17 loaded in the cartridge loading unit 15 by means of the reader/writer 101. If the loaded ink cartridge 17 is new, the date of first use and the device information is written to the IC chip 102.

When a printing process or cleaning process is executed, the calculation means 112 determines the dot count denoting the number of ink droplets discharged from the inkjet head 21 in the printing process, flushing process, or cleaning process, updates the total ink consumption value by adding the calculated dot count to the ink consumption value already stored as a dot count in the IC chip 102, and writes the updated dot count to the IC chip 102.

Figure 8:
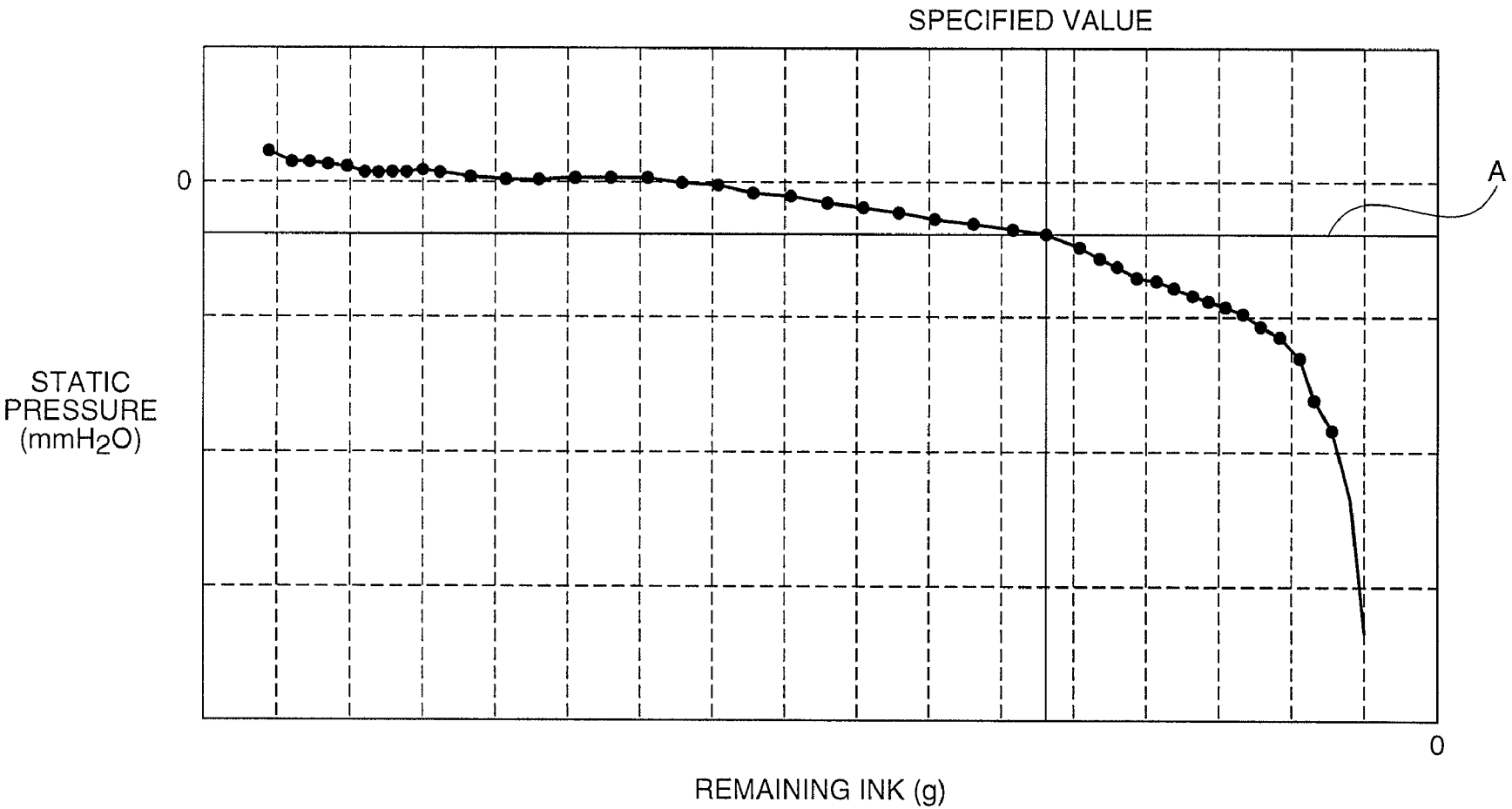
FIG. 8 is a graph showing the relationship between internal pressure and how much ink remains in an ink cartridge in the inkjet printer shown in FIG. 1.

FIG. 8 illustrates the relationship between internal pressure and how much ink remains in the ink cartridge 17 in the inkjet printer 1. The pressure inside the ink cartridge 17 decreases gradually as the remaining ink level drops, and then drops abruptly when the internal pressure goes below the urging force A of the coil tension spring 57 and the cartridge is nearly empty.

Figure 9A:
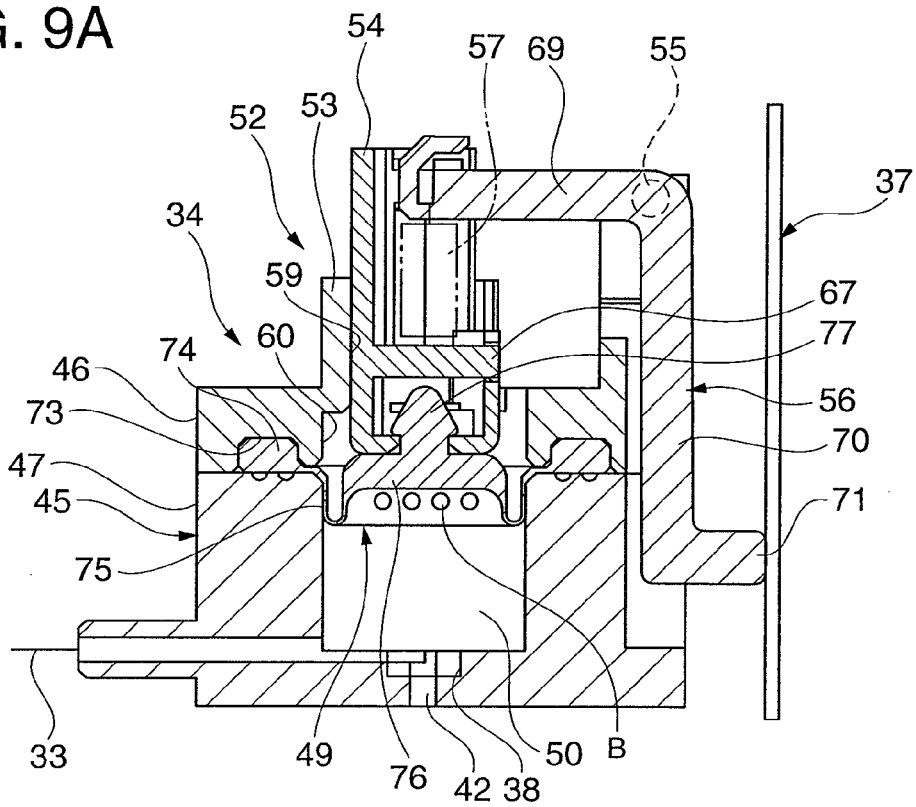
FIGS. 9A and 9B are section views illustrating configurations of a fluid chamber of an ink supply mechanism of the inkjet printer shown in FIG. 1.
Figure 9B:
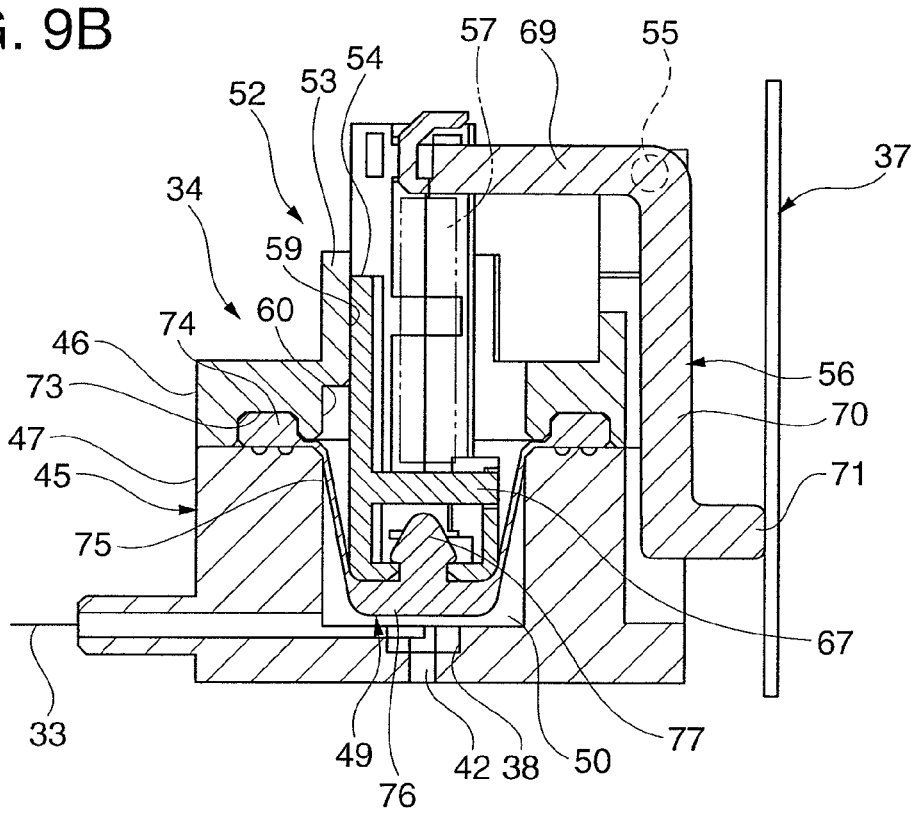

FIGS. 9A and 9B illustrate two possible starting positions (two of a range of possible positions) of the ink chamber 50 just prior to the start of a vacuum cleaning process. Just prior to a cleaning process (as well as during), the carriage is in the standby position as illustrated in both FIGS. 9A and 9B. In both FIGS. 9A and 9B, the input part 71 of the rocker arm 56 is touching the regulator panel 37, the distal end part of the arm part 69 is raised, and the piston 54 is linked through the coil tension spring 57. When the remaining ink level in the ink cartridge 17 is high, the pressure within the ink cartridge 17 is positive (as shown in FIG. 8). The pressure levels within the ink cartridge 17 and the ink chamber 50 are substantially equalized due to the fluid communication path between the ink cartridge 17 and the ink chamber 50. As a result, when the remaining ink level in the ink cartridge 17 is high, the pressure level within the ink chamber 50 is positive, and the urging force of the coil tension spring 57 is sufficient to expand the volume of the ink chamber 50 to the configuration illustrated in FIG. 9A. As the remaining ink level in the ink cartridge 17 decreases, the pressure within the in ink chamber 50 decreases. When the remaining ink level in the ink cartridge 17 decreases and the internal pressure enters the range below the urging force A of the coil tension spring 57 during a cleaning process, the ink chamber 50 in the subtank 45 goes to a sufficient negative pressure to prevent the piston 54 from rising. As a result, the piston 54 overcomes the urging force A of the coil tension spring 57 as shown in FIG. 9B. In the position shown in 9B, any air bubbles B are constrained to the recess 38, from which the air bubbles B can be purged.

If sufficient ink remains in the ink cartridge 17 and the internal pressure is greater than or equal to the urging force A of the coil tension spring 57, the pressure inside the ink chamber 50 of the subtank 45 will not decrease sufficiently so as to prevent the piston 54 from rising. As a result, the piston 54 is held in the raised position by the coil tension spring 57 as shown in FIG. 9A. Any ink that would be removed as a result of simply vacuuming ink from the inkjet head 21 for the configuration shown in FIG. 9A would be removed alone without the bubbles B being purged.

As a result, in many embodiments, the control unit 100 controls the cleaning process in accordance to the relationship between the remaining ink level and the negative pressure in the ink cartridge 17. Note that in this relationship between the remaining ink level and the negative pressure the amount of ink remaining when the internal pressure of the ink cartridge 17 goes below the urging force A of the coil tension spring 57 is set as a specified value and stored in the storage means 114.

Figure 10:
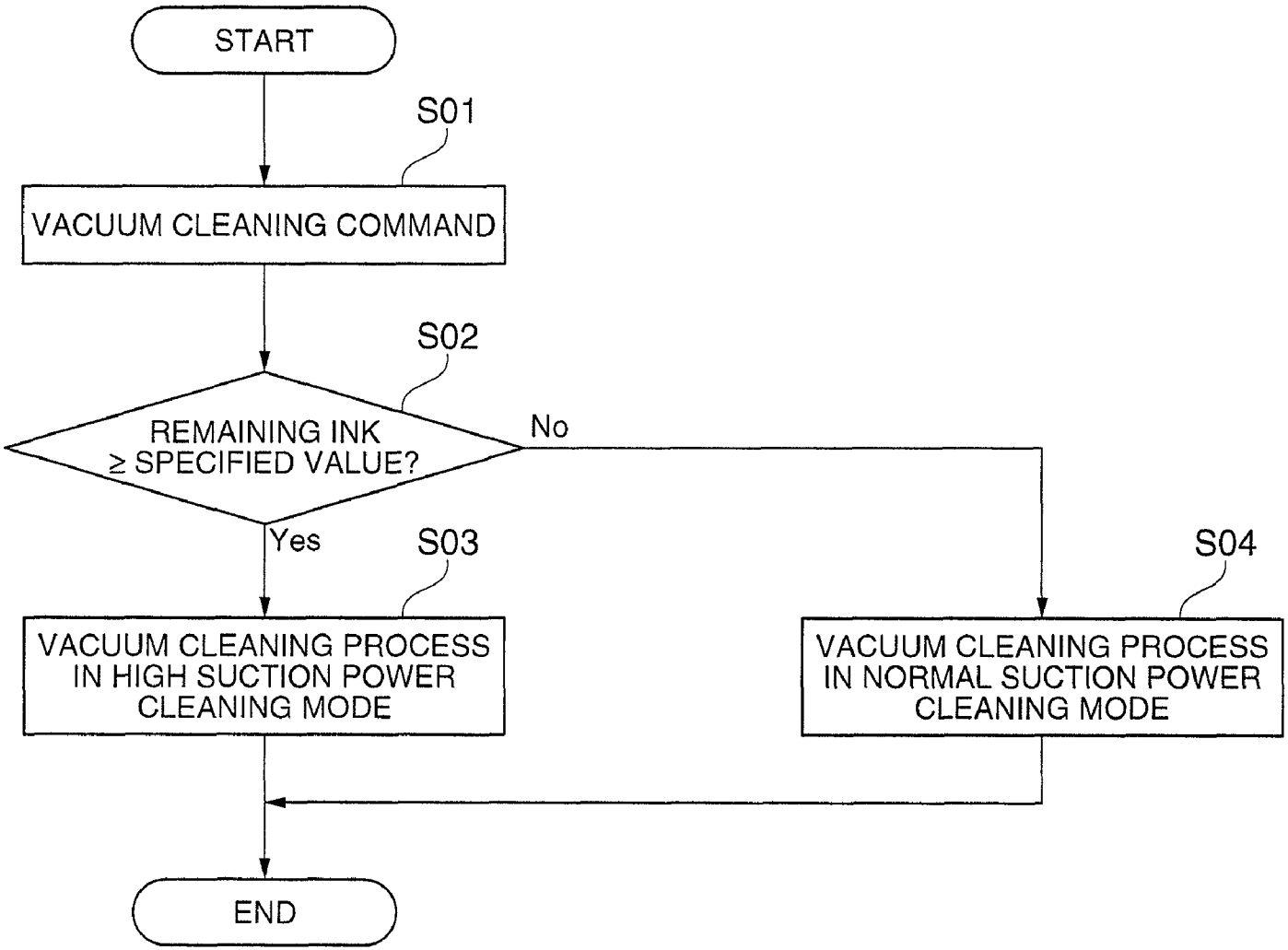
FIG. 10 is a flow chart illustrating control of a vacuum cleaning process by a control unit of the inkjet printer shown in FIG. 1.

Control of the cleaning process by the control unit 100 is described next with reference to the flow chart in FIG. 10. When a vacuum cleaning command for removing bubbles is sent to the control unit 100 at a specific timing or by a user action (step S01), the carriage 23 moves to the standby position. As a result, as shown in FIG. 9A, the input part 71 of the rocker arm 56, which moves in conjunction with the carriage 23, contacts the regulator panel 37 outside the carriage 23. The rocker arm 56 thus pivots, the distal end part of the arm part 69 rises, and the piston 54 linked thereto by the coil tension spring 57 slides inside the cylinder 53 and is pulled up. The calculation means 112 of the control unit 100 then calculates the remaining ink level in the ink cartridge 17, and the comparison means 113 determines whether or not the remaining ink level in the ink cartridge 17 is less than a specified level (comparison step; step S02).

As described above, when the amount of ink remaining in the ink cartridge 17 decreases, the negative pressure increases. As a result, the load required to expand the ink chamber 50 and draw ink increases, and the carriage motor 26*b* electrical current increases greatly. The remaining ink level in the ink cartridge 17 can therefore be determined from the change in the electrical current by calculating the change in current required to move the carriage 23 based on the carriage motor 26*b* current detected by the detection means 111.

If as a result of this comparison the remaining ink level is determined to be greater than or equal to the specified level (step S02 returns Yes), the CPU 115 sets the cleaning process to a high suction power cleaning mode (first cleaning mode) (setting step; step S03). When the first cleaning mode is set, the control unit 100 executes the cleaning process in the first cleaning mode, and then ends vacuum cleaning control. More specifically, with the cap 27 firmly capping the nozzle surface of the inkjet head 21, the ink path 31 is closed by the choke valve 39, and the ink vacuum mechanism 29 vacuums the inside of the cap 27 and vacuums ink from the ink nozzles of the inkjet head 21. In the vacuum cleaning process in the first cleaning mode, the supply of ink from the ink cartridge 17 is interrupted by the choke valve 39, suction pressure is applied, and the pressure inside of the ink chamber 50 of the subtank 45 is lowered. As a result, the piston 54 is pulled down in resistance to the urging force A of the coil tension spring 57 as shown in FIG. 9B, bubbles B accumulated at the bottom end of the piston 54 are pushed into the recess 38 formed in the bottom of the cylinder 53 part of the ink chamber 50, and are removed through the path 42 that communicates with the self-sealing unit 36.

If the remaining ink level is less than the specified level (step S02 returns No), the CPU 115 sets the cleaning process to a normal suction power cleaning mode (second cleaning mode) (setting step; step S04). When the second cleaning mode is set, the control unit 100 executes the cleaning process in the second cleaning mode, and then ends vacuum cleaning control. More specifically, with the cap 27 firmly capping the nozzle surface of the inkjet head 21, the ink path 31 is not closed by the choke valve 39, and the ink vacuum mechanism 29 vacuums the inside of the cap 27 and vacuums ink from the ink nozzles of the inkjet head 21 with a suction pressure. The suction pressure used in the second cleaning mode can be lower than the suction pressure used in the first cleaning mode, and can be equal to the suction pressure used in a normal cleaning process that vacuums ink that has increased in viscosity from the ink nozzles of the inkjet head 21. In the vacuum cleaning process in the second cleaning mode, the pressure inside the ink chamber 50 of the subtank 45 is already sufficiently negative to overcome the urging force A of the coil tension spring 57 (as shown in FIG. 9B). As a result, the bubbles B accumulated at the bottom end of the piston 54 are already confined to the recess 38 formed in the bottom of the cylinder 53 part of the ink chamber 50, and are sucked out from the path 42 that communicates with the self-sealing unit 36.

As described above, because the ink cartridge 17 stores ink in a sealed ink pack of variable capacity, the amount of ink that must be vacuumed to compress the ink chamber 50 during cleaning is reduced as a result of the remaining ink level in the ink cartridge 17 decreasing. If the remaining ink level in the ink cartridge 17 is greater than or equal to the specified value, the first cleaning mode is used for vacuum cleaning. If the remaining ink level in the ink cartridge 17 is less than the specified value, the second cleaning mode is used for vacuum cleaning. The suction pressure used in the second cleaning mode can be lower than in the first cleaning mode. The use of the second cleaning mode reduces the frequency of first mode cleaning operations that consume a lot of ink, which enables minimizing ink waste from vacuum cleaning. More specifically, vacuum cleaning can be desirably applied to remove bubbles B from inside the ink chamber 50 while minimizing ink waste resulting from vacuum cleaning, a desirable ink discharge operation can be maintained, efficient, high quality printing is possible, and device size and cost can be reduced with a simple configuration.

Some of the above discussed features serve to enhance the vacuum cleaning process. For example, the recess 38 formed in the ink chamber 50 serves a collection site for the bubbles B so that they can be purged. The recess 38 communicates with the path 42 that is the ink supply path to the inkjet head 21. The bubbles B in the ink chamber 50 can be guided into and collected in the recess 38 when the ink chamber 50 is compressed by vacuum cleaning, and the bubbles can be drawn from the recess 38 into the path 42 and purged. Furthermore, because the remaining ink level in the ink cartridge 17 can be obtained from the electrical current required to move the carriage 23, the electrical current changing in accordance with the amount of ink remaining in the ink cartridge 17, how much ink remains in the ink cartridge 17 can be accurately determined and the vacuum cleaning mode can be changed smoothly.

In many embodiments, the amount of ink disposed within the ink chamber 50 at the start of a first mode cleaning process is a function of the remaining ink level in the ink cartridge 17. This relationship is driven by the varying urging force provided by the coil tension spring 57 for different amounts of extension of the coil tension spring 57. It should be noted that the amount of fluid vacuumed during vacuum cleaning in the first cleaning mode can be adjusted according to the remaining ink level in the ink cartridge 17 calculated by the calculation means 112. More specifically, after setting the vacuum cleaning process to the high suction power cleaning mode (first cleaning mode) (setting step; step S03), the amount of ink vacuumed during the vacuum cleaning process in the first cleaning mode can be set as low as possible based on the calculated remaining ink level in the ink cartridge 17. Note that the amount of ink vacuumed can be easily adjusted by adjusting the vacuuming time of the ink vacuum mechanism 29. By thus adjusting and minimizing the amount of ink vacuumed according to the remaining ink level in the ink cartridge 17, the amount of ink wasted by the vacuum cleaning process may be further suppressed.

The embodiment described above determines the remaining ink level in the ink cartridge 17 from the electrical current required to move the carriage 23. The remaining ink level in the ink cartridge 17 can also be determined from the amount of ink discharged from the inkjet head 21. More specifically, the calculation means 112 can calculate the remaining ink level in the ink cartridge 17 based on the ink information in the IC chip 102 and the amount of ink discharged from the inkjet head 21 and consumed by printing processes and flushing. By thus accurately determining the remaining ink level in the ink cartridge 17 from the volume of ink discharged from the inkjet head 21, the vacuum cleaning mode can be changed smoothly.

In addition to inkjet printers as described above, the fluid supply device according to the invention can be applied in fluid supply devices that supply fluid to fluid discharge heads for discharging a variety of fluids, including color agent discharge heads used in manufacturing color filters for liquid crystal displays, electrode material discharge heads used for forming electrodes in organic electroluminescent (EL) display and field emission display (FED) devices, and bio-organic material discharge heads used in biochip manufacture. The invention can also be used in a fluid supply device for a reagent discharge device used as a precision pipette.

The concept of a fluid as used herein also includes gels, high viscosity materials, and mixtures of a solid in a solvent, and the concept of an ink includes aqueous inks and oil-based inks.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A fluid supply device, comprising:

a main tank in which fluid is stored;

a fluid chamber to which fluid is supplied from the main tank;

a head that discharges fluid supplied from the fluid chamber, the head comprising a fluid discharge nozzle;

a movable carriage on which the head and the fluid chamber are mounted;

an expansion mechanism that causes the fluid chamber to expand so as to draw fluid from the main tank, the expansion mechanism actuated via a movement of the movable carriage;

a suction mechanism that vacuums fluid from the fluid discharge nozzle and cleans the nozzle;

a remaining fluid detection unit that determines a remaining fluid volume in the main tank;

a comparison unit that compares the remaining fluid volume in the main tank with a specified value; and a setting unit that sets a cleaning mode selected from a group consisting of a first cleaning mode in which a first amount of fluid is vacuumed from the nozzle and a second cleaning mode in which a second amount of fluid is vacuumed from the nozzle that is less than the first amount;

the fluid supply device cleaning the nozzles in the first cleaning mode when the remaining fluid volume in the main tank is determined to be greater than or equal to the specified value as a result of the comparison unit comparing the remaining fluid volume in the main tank with the specified value, and cleaning the nozzles in the second cleaning mode when the remaining fluid volume is less than the specified value.

2. The device of claim 1, further comprising a recess formed in the fluid chamber that communicates with a fluid path to the head.

3. The device of claim 1, wherein the amount of fluid vacuumed from the nozzle when cleaning in the first cleaning mode changes according to the remaining fluid volume in the main tank.

4. The device of claim 1, wherein the remaining fluid detection unit determines the remaining fluid volume in the main tank from an electrical current required to move the carriage.

5. The device of claim 1, wherein the remaining fluid detection unit determines the remaining fluid volume in the main tank from a volume of fluid discharged from the head.

6. A printing device that executes a printing process by discharging ink from a head onto a conveyed medium, comprising the fluid supply device of claim 1 as a device that supplies ink to the head.

7. A printing device that executes a printing process by discharging ink from a head onto a conveyed medium, comprising the fluid supply device of claim 2 as a device that supplies ink to the head.

8. A printing device that executes a printing process by discharging ink from a head onto a conveyed medium, comprising the fluid supply device of claim 3 as a device that supplies ink to the head.

9. A printing device that executes a printing process by discharging ink from a head onto a conveyed medium, comprising the fluid supply device of claim 4 as a device that supplies ink to the head.

10. A printing device that executes a printing process by discharging ink from a head onto a conveyed medium, comprising the fluid supply device of claim 5 as a device that supplies ink to the head.

11. A method for cleaning a printing device, the method comprising: drawing ink from a main tank into a fluid chamber via an expansion mechanism that causes the fluid chamber to expand, the expansion mechanism being actuated via a movement of a carriage on which the fluid chamber is mounted; measuring a remaining ink volume in a main tank of the printing device; comparing the remaining ink volume with a predetermined volume of ink; when the remaining ink volume is greater than or equal to the predetermined volume, selecting a first cleaning mode; when the remaining ink volume is less than the predetermined volume, selecting a second cleaning mode; and suctioning an amount of ink from an ink-discharging head of the printing device, the amount of ink determined in response to the selected cleaning mode, wherein the amount of ink suctioned for the first cleaning mode exceeds the amount of ink suctioned for the second cleaning mode.

12. The method of claim 11, wherein said suctioning an amount comprises drawing ink from the fluid chamber in fluid communication with the main tank via an expansion mechanism that varies the volume of the chamber, and wherein the volume of the fluid chamber is reduced in response to the ink being drawn from the fluid chamber.

13. The method of claim 12, wherein the amount of ink suctioned when cleaning in the first cleaning mode is changed in response to the remaining ink volume in the main tank.

14. The method of claim 12, wherein the remaining ink volume in the main tank is determined from an electrical current required to move the carriage, on which the ink-discharging head and the chamber are being mounted on the carriage.

15. The method of claim 12, wherein the remaining ink volume in the main tank is determined from a volume of ink discharged from the ink-discharging head.

* * * * *